United States Patent [19]

Campbell

[11] 4,132,142

[45] Jan. 2, 1979

[54] METHOD AND APPARATUS FOR REPRODUCING A MUSICAL PRESENTATION

[75] Inventor: Joseph M. Campbell, Lewisburg, Tenn.

[73] Assignee: Teledyne Industries, Inc., Los Angeles, Calif.

[21] Appl. No.: 681,093

[22] Filed: Apr. 28, 1976

[51] Int. Cl.[2] ..... G10F 1/00; G10G 3/04

[52] U.S. Cl. ..... 84/115; 84/462; 84/DIG. 29

[58] Field of Search ..... 84/1.02, 1.03, 1.28, 84/115, 461, 462, DIG. 29

[56] References Cited

U.S. PATENT DOCUMENTS

| | | | |
|---|---|---|---|
| 3,539,701 | 11/1970 | Milde | 84/1.28 |
| 3,647,929 | 3/1972 | Milde, Jr. | 84/1.02 X |

OTHER PUBLICATIONS

Service Manual for Teledyne Piano Recorder/Player, Model PP-1, Assembly No. ATL-3288, Oct. 20, 1975.

Assembly Instruction for Teledyne Piano Recorder/-Player, Model PP-1, Assembly No. ATL-3288, Jul. 10, 1975.

*Primary Examiner*—Stanley J. Witkowski

*Attorney, Agent, or Firm*—Jim Zegeer

[57] ABSTRACT

There is disclosed a method and apparatus for reproducing a musical presentation wherein musical data, from such presentation, such as keyboard actuations of a keyboard-type musical instrument, is encoded and stored in a code which has information contained in the transitions only and the sense and direction of such transitions are ignored. This avoids several major drawbacks of bi-phase level code previously disclosed in the prior art because the (1) phase of the signal need not be maintained and, (2) the bi-phase level code cannot be recovered following a dropout until a 1-0 or a 0-1 transition occurs.

There is also disclosed a data dropout detection system for assuring that the wrong music is not played.

13 Claims, 8 Drawing Figures

FIG 1
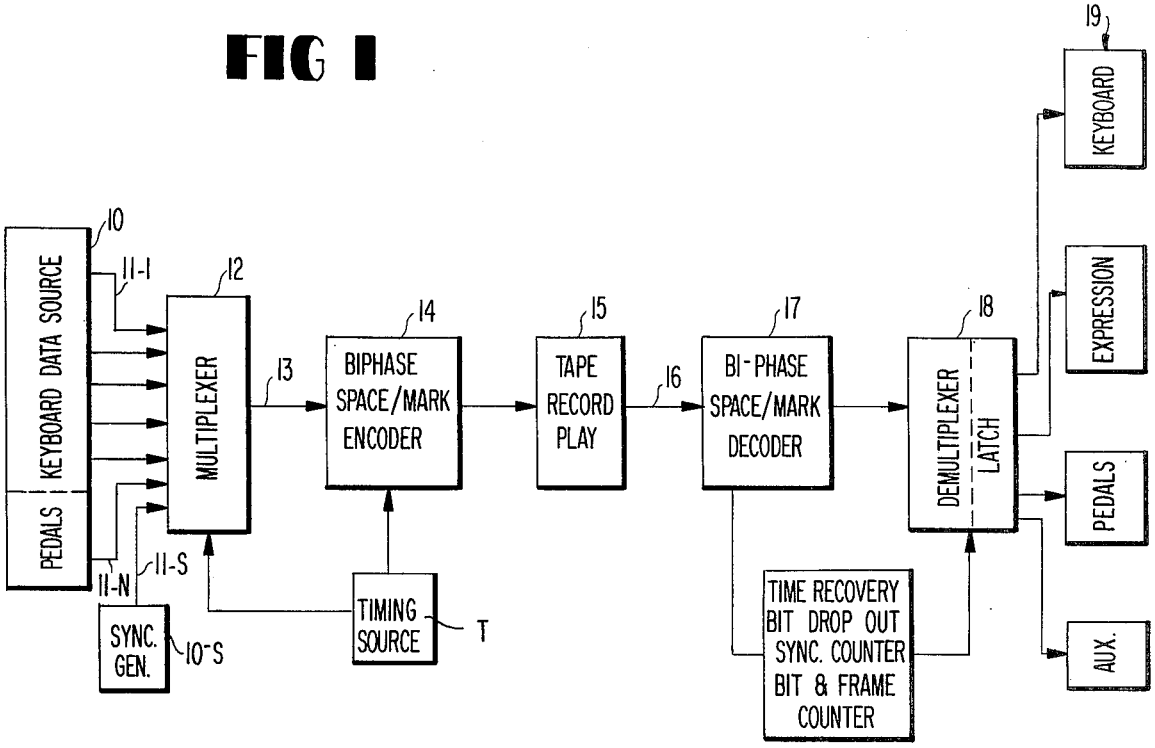
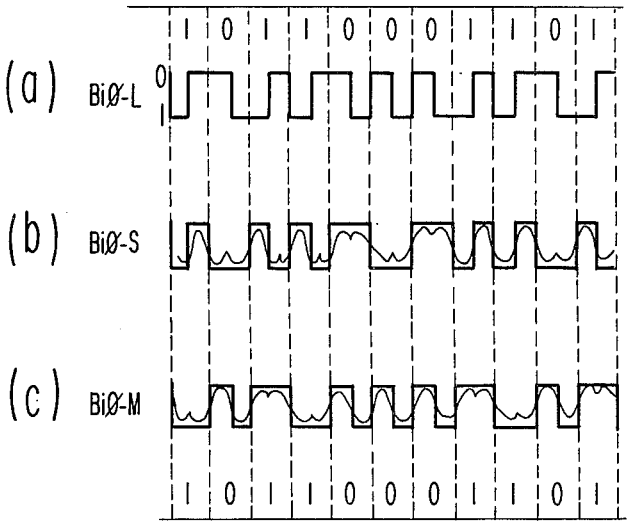
FIG 2
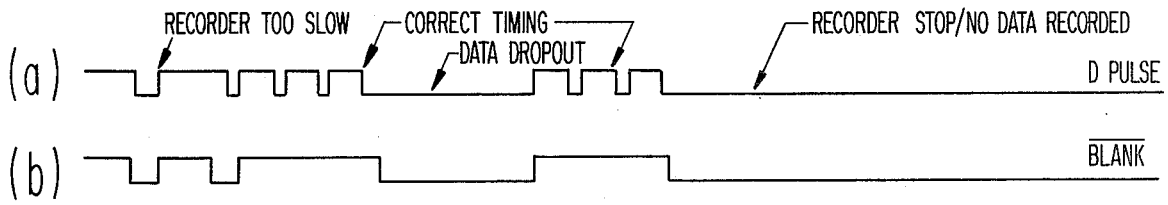
FIG 6

METHOD AND APPARATUS FOR REPRODUCING A MUSICAL PRESENTATION

BACKGROUND OF THE INVENTION

Automated musical instruments have been known for many years. Automation of keyboard actuations has been accomplished in the piano, organ, carillon, etc. when the keyboard actuations are translated to perforations in a paper tape, which constitutes a storage medium, and then these recorded actuations are used to actuate the instrument to produce the music. In punched paper memories, such as the player piano or organ, there is typically one channel for each key on the piano or organ keyboard. In the electrification of such instruments, the changeable memories of various types have been used. For example, in Cooper U.S. Pat. No. 3,380,026, magnetic core elements are used as memory devices into which are "read" the condition of a plurality of actuator elements such as the stops or coupler switches of an organ. These stored actuations are "read out" at selected times to reactuate the actuator elements and reproduce the stored musical information. Inexpensive magnetic tape cassettes are disclosed in the prior art, as in Schmoyer U.S. Pat. No. 3,388,716 and in Englund U.S. Pat. No. 3,604,299, both of which disclose multiplex recording of key switch actuations, one of which is a frequency multiplexing scheme whereas the other is a time division multiplexing scheme. Various forms of encoding systems have been utilized, as, for example, in Peterson U.S. Pat. No. 3,683,096, a recurring frame of pulses has one pulse therein for each of the key switches of the musical instrument and a pulse modifier is utilized for modifying in a predetermined manner a specific pulse in each frame and these modified pulses are thereafter decoded. In Wheelwright U.S. Pat. No. 3,771,406, the key switch actuations are encoded into a five bit binary code which is loaded into a shift register for a parallel to a serial conversion; and in Maillet U.S. Pat. No. 3,789,719, key switch actuations are loaded directly into a shift register which, for a piano, would have 88 stages, one for each key, and additional ones for the other controls of the unit, and a key pulse is generated by the last stage of the shift register and these pulses along with the clock pulse are recorded directly upon the tape for subsequent playback. Finally, in Vincent U.S. Pat. No. 3,905,267, the keyboard switch actuations are passed through a multiplexer to serialize the key switch actuations which are then encoded in a biphase level encoder, best shown in FIG. 6 and the waveforms of FIG. 7 of U.S. Pat. No. 3,905,267. The bi-phase level data may be further encoded to provide a double density encoding shown in the waveform diagrams of FIG. 9 of U.S. Pat. No. 3,905,167 which is subsequently recorded upon a magnetic tape, played back, decoded and demultiplexed for subsequent reactuation of the piano keyboard.

With respect to all prior art encoding and decoding schemes, they all have serious drawbacks because they appear to be attempts to apply modern electronic technology to electronic player pianos but have failed to really grasp or apply the technology in such a way as to make it compatible with the playing back of recorded music. In some prior art systems, if the tape recorder is stopped while notes are being played, the last notes played may be held on which is undesirable at best and may cause damage to the system. Moreover, there are several places that will cause wrong notes to be struck in a musical system. In all cases, striking the wrong note sounds much worse than striking no note at all. The first problem is that when the recorder is started, or when the electronics are first powered on, there is no synchronization of the internal electronic counters to the data that is recovered from the recorder until the first sync code is received. If this is permitted to happen, it can cause wrong notes to be struck at the beginning of replay. The second problem is of more serious consequence, depending on the code used, because if in the middle of the replay the tape has a dropout, the electronics lose the sync and wrong notes are struck. In any fast scan multiplex system, all notes that are on at the time of the dropout may be shifted either up or down the scale until the sync code is recovered again. Finally, accidental detection of a wrong sync code due to noise, misadjustment of controls or the data information contained in the sync code causes the playing of wrong music because of the improper synchronization.

According to the present invention, a data detector is provided which has a retriggerable monostable multivibrator. The output of this retriggerable monostable multivibrator stays high after a positive going edge is applied to the input for a time determined by an RC timing circuit. As long as the positive going edges occur in less than the predetermined time, the monostable multivibrator is reset and begins timing out again. Thus, if due to a slow tape speed, data dropout, recorder stopping, or no information recorded on the tape, no edge occurs so the device times out and clears the sync counter and the input register, both of which prevent notes from being struck or being held in a closed state.

To insure that power is on at the start of the tape record or after data dropout of the tape that no wrong notes are struck, I provide a sync counter which counts three sync codes before allowing any note to be struck. This sync counter allows for the posssibility that a sync code could possibly occur randomly in the data information and rejects the false sync code. In essence, this requires two complete frames of data to be occurred before any notes may be struck after any disturbance causes the data detector or sync detector gates to indicate a malfunction.

In the bi-phase level coded waveform as disclosed in the Vincent patent, there are two significant drawbacks, the first of which is that the phase of the signal must be maintained by the system if it be recorded on tape and, secondly, if a dropout occurs the 1-0 relationship cannot be recovered until a 1-0 or 0-1 transition occurs in the NRZ waveform. What actually occurs in the playing of music is that all zeros (no music) become all ones (all notes being played). This also occurs during the stopping and starting of the recorder.

I have discerned that a number of the problems involved in coding systems for musical performances are that the bi-phase level code requires transition to occur in both position and sense so that in the playing of music, all zeros (no music) become all ones (all notes being played). I have determined that the problem with this coding scheme is that in the recording of keyboard music, the information is highly weighted with zeros (no key closures) and, therefore, in accordance with the invention, a code used for a slow recorder is such that the data (ones and zeros) would look like all zeros. The bi-phase (or mark) code, as disclosed at page 42 of the Telemetry Standards Document 106-71 (a portion of which is reproduced in FIG. 2 hereof), has as zeros information the wide spacing between transitions.

There is always a transition at the beginning of each bit period which can be recovered as the self-clocking portion of the code. The information is therefore contained only in the interbit transitions and not in the direction and sense of transition as in the bi-phase level code. Moreover, the data may be inverted and still be satisfactorily recovered. If a data dropout occurs, the data detector can immediately regain correct phasing without errors.

The above and other objects, advantages and features of the invention will become more apparent when considered in light of the accompanying drawings wherein:

DESCRIPTION OF THE DRAWINGS

FIG. 1 is a block diagram of an electronic record and player system for musical instruments;

FIGS. 2(*a*), (*b*) and (*c*) are a sequence of waveform diagrams taken from page 42 of Telemetry Standards Document 106-71;

FIG. 6(*a*) is a waveform diagram of the "D Pulse" FIGS. 4A and 4B illustrating various problems which can occur in the playback of a recorded musical presentation and FIG. 6(*b*) is a waveform diagram of the "blank" pulse corresponding thereto.

DETAILED DESCRIPTION

Figure 3A:
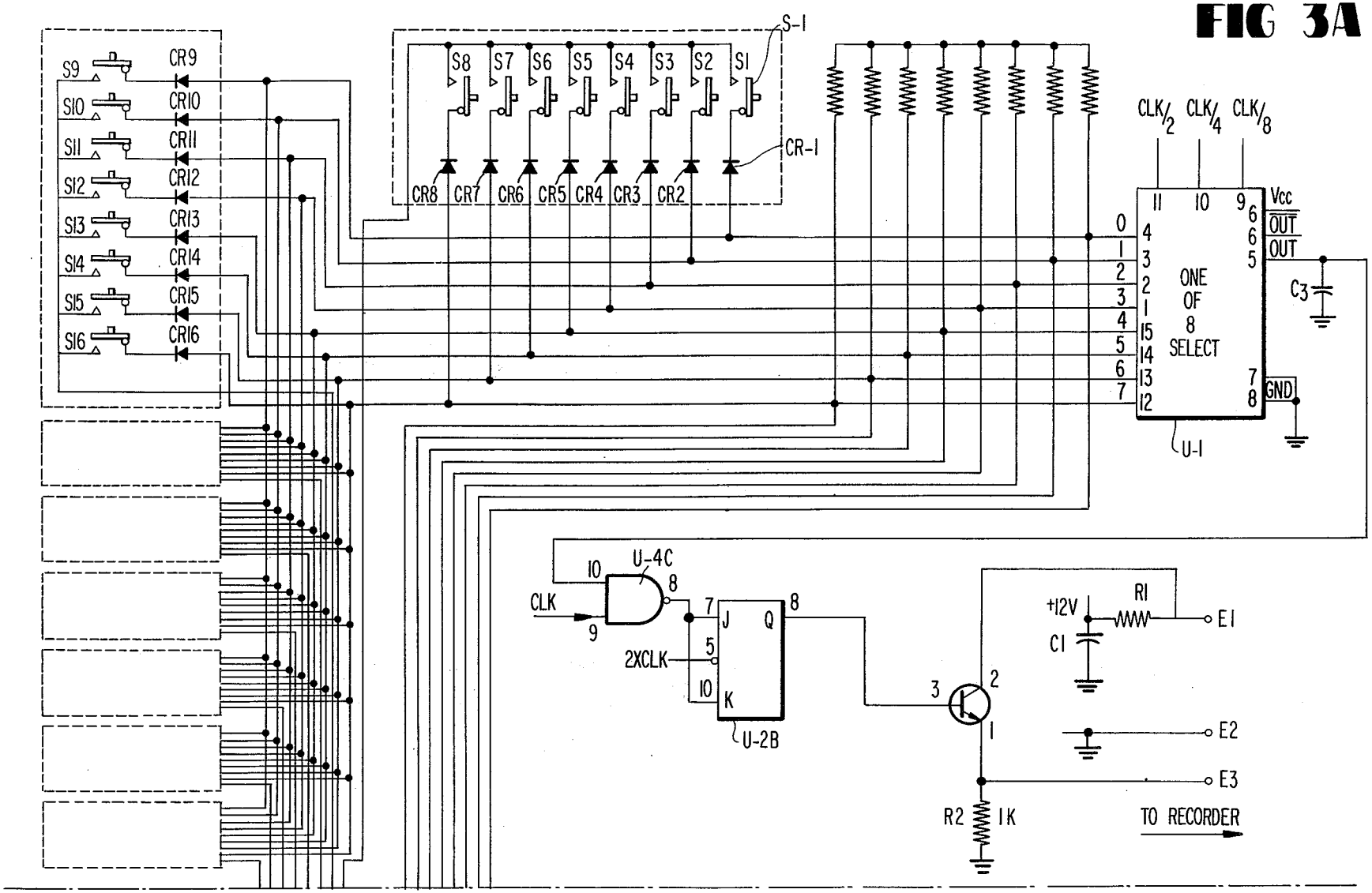
FIGS. 3A and 3B taken together, are a detailed schematic of the key switch scanning and encoding system incorporating the invention.

Attached hereto and incorporated herein as an integral part of the disclosure of this specification, is the "Service Manual" for Teledyne Piano Recorder/Player Model PP-1 Assembly Number 3288 ATL 3263, a publication of the assignee hereof and sometimes referred to hereinafter as "Service Manual".

Attached hereto and incorporated herein as an integral part of this specification is the "Assembly Instruction for Teledyne Piano Recorder/Player Model PP-1 Assembly Number ATL-3288 Document Number ATL-3262"; a publication of the assignee hereof and sometimes referred to hereinafter as "Installation Manual".

The above publications describe in detail a specific and preferred embodiment of an electronic player piano incorporating the invention defined in the claims hereof as made and sold by the assignee hereof.

Referring now to FIG. 1, the keyboard of a piano is designated by the numeral 10 and constitutes the keyboard-pedal data source. It could be any musical keyboard source instrument such as a harpsicord, carillon, organ, piano, etc., and each output or switch actuation is indicated by a single line 11-1 through 11-N, the number of such output lines corresponding to the number of key switch actuations to be sensed and recorded, for example, eighty keys (in one embodiment disclosed herein), the "sustain" and "loud" pedals of an eighty-eight key piano may be sensed. A sequence of synchronizing bits from sync generator 10-S is provided on line 11-S. A multiplexer 12 scans or looks at each individual line 11-1. . . 11-S in a times sequence which constitutes frames. Thus, the key switch, sustain and loud pedal, actuations are sensed by the digital multiplexer 12, one at a time, and in a generally sequential fashion. However, if no transpositions are contemplated, it is not necessary that they be sequentially examined, it being evident from the description given in connection with FIGS. 3A and 3B that they may be looked at or scanned in groups and in any fashion or order, the only criteria being that the position of the particular switch in its scan time be maintained in the entire system. The timing source T is shown in FIG. 3B, and is described in the section hereafter entitled "Multiplexing".

The multiplexer thereby translates the parallel data of the key switch actuations to a serial data stream along its output line 13. This data is then encoded to a bi-phase space (or mark) signal in bi-phase space (or mark) encoder 14 and then recorded on a tape in tape recorder 15. It will be appreciated that tape recorder 15 is conventional in all material respects and need not be disclosed or described in any detail herein. It can be the same as is disclosed in any of the prior art patents referred to earlier herein for recording digital data on tape or as shown in the included "Service and Installation" Manuals.

Such tapes may be recorded beforehand by known or accomplished artists or in home recordings, or rerecordings of punched paper rolls, etc. In the case of recording made by stars, performers and the like, these recordings may be sold separately and apart from the recording system per se. That is to say, a tape may be encoded and the strings of a piano, for example, struck or actuated by hammers or the like in exactly the same manner as an accomplished artist would be on a piano which is set up for playback operation only in the manner illustrated in FIGS. 4A and 4B hereof. In other words, one need not equip a piano for the record function disclosed herein.

Figure 4A:
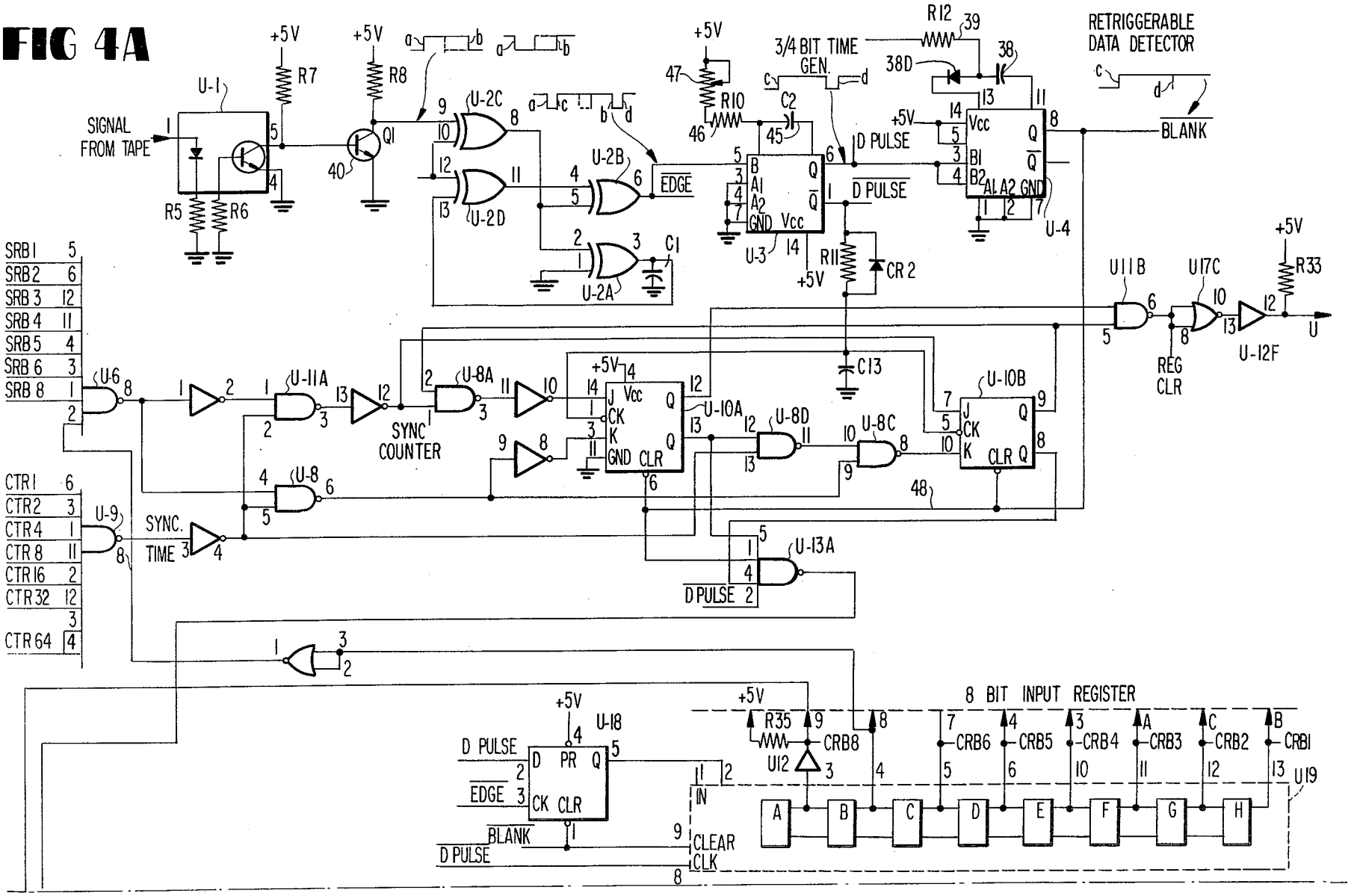
FIGS. 4A and 4B, taken together, are a detailed schematic of the playback electronics.
Figure 4B:
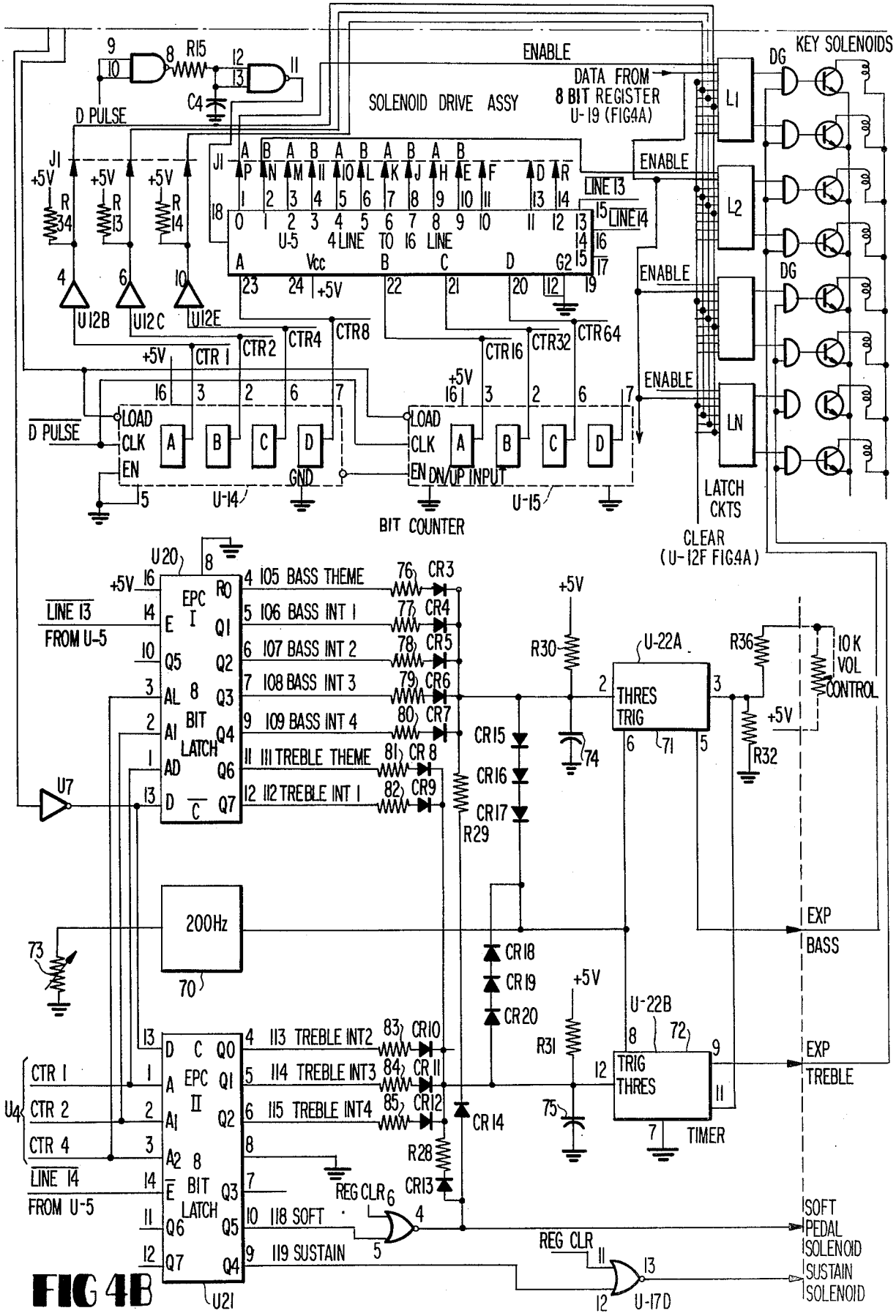

On playback by the tape recorder 15, the bi-phase space (or mark) data appears at the output of a read head and is fed through correcting networks and amplifiers to recover the digital signal. The data from the read head is approximately a sine wave, but the output from the amplifier on line 16 is a square wave signal. Moreover, the signal from the read head has encoded therein the clock data which must be recovered and used in the demultiplexing operation. The time recovery, bit dropout, sync counter, bit and frame counter circuitry is shown in FIGS. 4A and 4B and described in detail in the section entitled "The Decoder", which recovers the timing signals, "The Data Dropout Detector" which detects the bit dropout, "Sync Counter" for counting frames of sync pulses and the demultiplex and latch circuit.

The bi-phase space (or mark) decoder circuit 17 decodes the incoming data on line 16 and applies same to demultiplexer 18 which distributes the data to the appropriate control channels in the storage and solenoid actuator circuits 19.

Figure 3B:
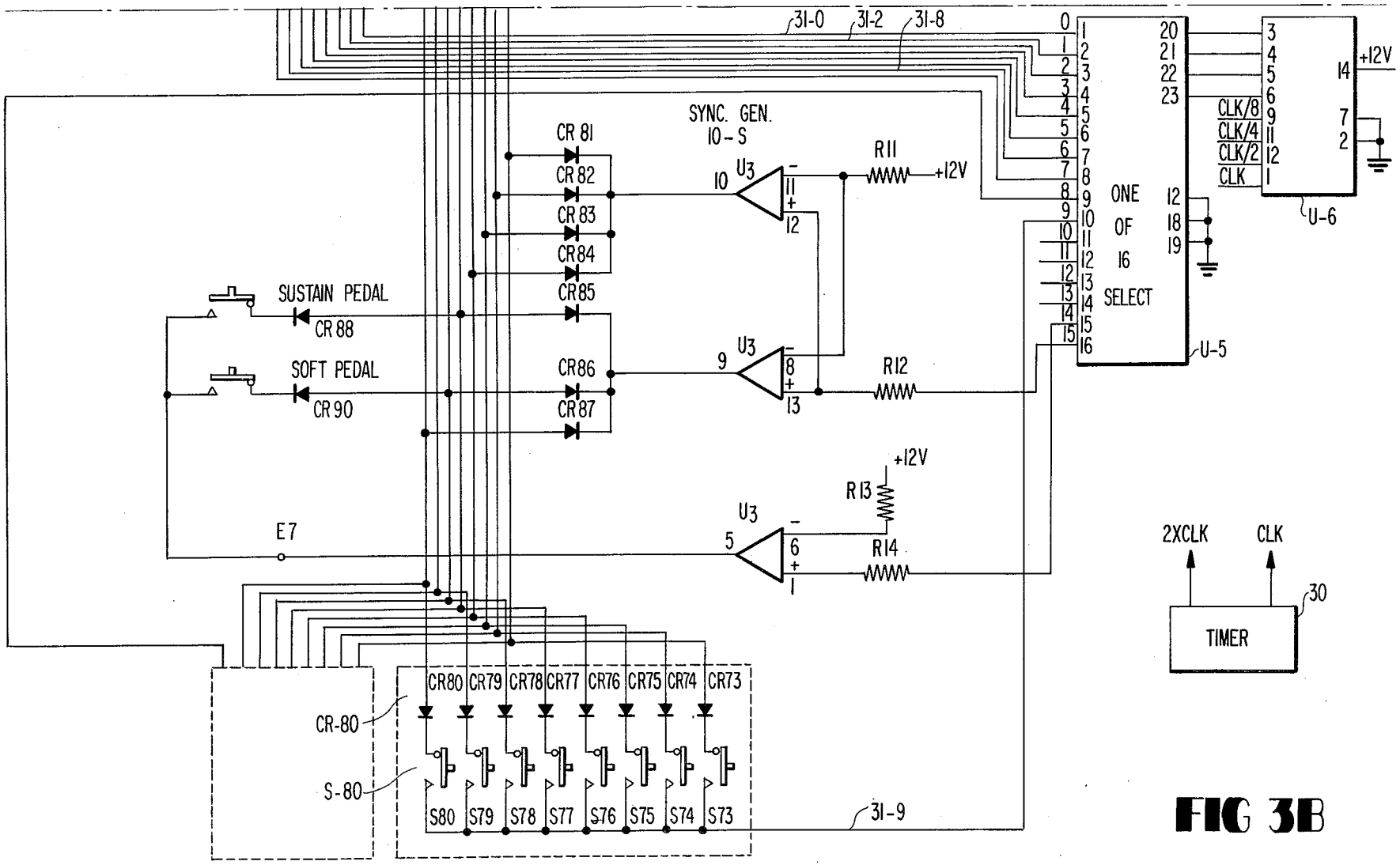

The playback logic, shown in FIGS. 3A and 3B, also decodes the expression bits and provides bass and treble outputs to control the volume of play.

Referring now to FIG. 2, the waveforms of a sequence of data bits (10110001101) are shown in three different bi-phase encoding schemes, the first of which is shown in line A of FIG. 2, namely, the bi-phase level encode scheme. As disclosed in the above-referenced Telemetry Publication, this bi-phase level (or split phase Manchester II ± 180°), a "one" is represented by a 1 0, and a "zero" is represented by a 0 1. Thus, the sense of the transition as well as the position thereof represents data. In the bi-phase space (or mark), shown in line B of FIG. 2, there is a transition at the beginning of every bit period. However, a "one" is represented by no phase shift, i.e., a zero crossing, at the middle of (or interbit) the bit period. On the other hand, a "zero" in contrast is represented by a 180° phase shift (i.e., no transition or zero crossing) at the middle of (interbit) the bit period.

The exact opposite of the bi-phase space (or mark) is shown in line C of FIG. 2 wherein a transition occurs at the beginning of every bit period as in the case of the bi-phase space encoding scheme, but in this case, the representations of the one and the zero is exactly the reverse of that shown for the bi-phase space. Thus, in either the bi-phase space or the bi-phase mark, the sense of the transition is ignored and conveys no information whatever and it is the presence, in the case of the bi-phase mark, or absence, in the case of the bi-phase space, of a transition which determines the data. In accordance with the preferred practice of the present invention, the bi-phase space or mark encoding format is utilized since in this case, the predominant number of data bits is in the zero format so that the data stream looks essentially like all zeros and if a data dropout, loss of sync, etc. occur, the system immediately picks up playing zeros, e.g. not striking any notes. Some texts and literature may identify a bi-phase mark code as bi-phase space and vise versa; and some identify the code as "frequency doubling" or "pulse width NRZ 1. . .", e.g. see "Digital Magnetic Tape Recording for Computer Applications" by L. G. Sebestyen, Chapman and Hall, 1973.

MULTIPLEXING

Referring now to FIGS. 3A and 3B, each of the key switches is designated by the numerical S-1, S-2. . . S-80, there being eight such switches in a module, each switch having an isolation and blocking diode associated therewith, such diodes being labeled CR-1 and associated with switch S-1 and CR-80 is associated with switch S-80, etc. These key switches are multiplexed in ten groups of eight and integrated circuit selector U-1 (each integrated circuit element is fully identified in the "Service Manual") selects them one at a time in sequential order until eight are selected. The selector circuit U-1 has as its inputs clock/2, clock/4 and clock/8 inputs from seven stage counter U-6. The input to this counter is the clock input and it comes from a clock circuit 30. Timer circuit 30 contains a conventional oscillator which with a two-stage counter on its output stage so that the output is clock and clock divided by two. The clock signals "CLK" are applied as the inputs to terminal 1, a seven stage counter U-6, which in effect is a binary decimal decoder having its coded outputs on its output terminals 3, 4, 5 and 6, respectively, applied to the input terminals 20, 21, 22 and 23 of one of sixteen select circuit U-5. Select circuit U-5 has terminals 1-17 and the first ten outputs are used as enable signals on output lines 31-0 through 31-9. Thus, each of the modules containing switches S-1 - S-80 is enabled or strobed one at a time. The clock pulses, clock/2, clock/4, and clock/8 from terminals 9, 11, and 12 of U-6 are applied to the input terminals 9, 10, and 11 of integrated circuit U-1 and in conjunction with the 12-volt supply and resistors R-3 - R-10, sequentially sample each of the switches via their blocking diodes CR-1 - CR-80. Accordingly, there appears on the output terminal of integrated circuit U-1, a series of pulses, and in the disclosed embodiment, there will be one hundred and twenty-eight bit periods within a given time frame, i.e., the time it takes for a pulse to activate output terminal 17 of one of select circuits U-5. The bit assignments are shown on Chart 1 of the "Service Manual"; bit positions 89-104 are not used and bit position 116 is not used along with bit positions 119 and 120. As shown on the "bit assignment chart", the sustain and soft pedals occupy bit positions 117 and 118 in the frame whereas the bit 105-109 and 111-115 are used to activate the bass theme and bass theme intensity levels and the treble theme and treble intensity controls, respectively. Finally, bit positions 121-128 are assigned to the synchronizing bits which are generated when a strobe pulse appears on pin 17 of U-5, the zero at bit position 127 is a check bit.

ENCODING (FIGS. 3A and 3B)

It will be noted that the output of the selection circuit U-1 is in time frames with the data being in non-return to zero code format. This data (FIG. 5*a*) is applied as one input to the encoding circuit. As discussed earlier, in the recording of keyboard music, the information is highly weighted with zeros, that is, there are no key closures and, therefore, according to this invention, the code is such that for a slow recorder the data (ones and zeros) would all look like zeros. As shown at page 42 of the Telemetry Standards Document 106-71, the bi-phase space code has as zeros information the wide spacing between transitions. The information is contained in the transitions only and not in the direction or sense of the transition as in the bi-phase level code. Therefore, the data may be inverted and still be satisfactorily recovered. If a dropout occurs, the data detector immediately regains phasing without errors as discussed later herein. The circuit utilized to generate the code is shown in FIG. 3B and has a NAND gate U-4C which receives the $\overline{NRZ}$ data from the multiplexer circuit 12. The $\overline{NRZ}$ data is gated in NAND gate U-4C at the clock rate to generate the JK inputs to flip flop U-2B. The 2x clock is applied as one input of U-2B and the output of NAND gate U-4C are applied as inputs to produce and generate the bi-phase space/mark data. This data is applied to an output follower circuit (which is not here relevant) and this signal is the signal that is applied to the input terminals of the recorder for shaping and recording upon magnetic tape. See the "Service Manual" forming a part hereof.

Thus, as the artist plays the music upon the keyboard, the keyboard switches, S-1 - S-80, are closed and are scanned at a selected clock rate. This data is then multiplexed by the multiplexing arrangement described earlier herein to provide an $\overline{NRZ}$ data which is gated in NAND gate U-4C to generate the JK inputs to flip flop U-2B. The 2x clock from timer 30 (FIG. 5*b*) clocks the flip flop and the Q input of U-2B is the bi-phase space code (FIG. 5*b*) which is tape recorded.

It is, of course, not necessary that the musical data originate with a keyboard, for example, a punched paper piano roll can be converted to tape form by a brush-hole sensing arrangement with the brushes scanned as if they were the key switches S-1 - S-80.

THE DECODER (FIGS. 4A and 4B)

The decoder is shown in FIG. 4 and includes the $\overline{EDGE}$ detection circuit utilizing U-2 (of FIGS. 4A and 4B), the "D Pulse" monostable U-3, and the decoder using U-18. The four exclusive OR gates of U-1 and the delay generated by capacitor C1 generate a narrow spike called $\overline{\text{EDGE}}$ as shown in FIG. 4. Referring to FIG. 4A, when a zero is present at pin 9 of U-2C, pin 8 thereof will be high which places a high at pin 2 of U-2A and its output pin 3 will go high delayed by capacitor C1. This is applied to pin 13 of U-2D so that pin 11 thereof will go low and pin 6 of U-2B goes high. At the next transition (the small "b" shown in the waveform diagram leading into pin 9 of U-2C) pin 5 of U-2B will go low and pin 4 remains high momentarily so that a negative going pulse appears at pin 6 of U-2B. Each time a transition occurs another pulse is produced. These pulses are supplied to pin 5 of the monostable multivibrator U-3 and each time pin 5 of the multivibrator goes from zero to high, the ouptut pin of the multivibrator will go high. The multivibrator U-3 begins to time out when set by RC resistors 46, 47 and capacitor 45. The time out is set to be three quarter bit time. Once U-3 has timed out, pin 6 of the multivibrator U-3 returns to zero ready to be re-set. Multivibrator U-3 then produces one output for each bit.

DATA DROPOUT DETECTOR

As described earlier, and with reference to FIG. 6, if a dropout of data occurs in the tape recording, there can be a loss of sync which causes wrong notes to be struck during the frame of data in which the dropout occurs and this can be quite disconcerting to the listener. The same disconcerting playing of notes can occur if the tape recorder is stopped while notes are being played. The objective of this portion of applicant's invention is to sense or detect the dropout of data so as to prevent the playing of undesirable notes and/or avoid damage to the system. The circuit portion of FIGS. 4A and 4B which is most significant for this aspect of this invention is block U-4 which is the retriggerable data detector. The output of retriggerable monostable multivibrator circuit U-4 stays high as indicated in the waveform diagram from the Q output terminal 9 for a time determined by the values of feedback capacitor 38 and resistor 39. A diode 38D is used to discharge the capacitor 38. In the beginning, pulses are applied from the tape recorder output circuit, which are amplified by transistors Q1 and Q2 and their associated resistor networks and applied as an input to optical couple U-1. This optical coupling circuit U-1 is conventional, having as an output thereof a square wave which is applied as an input to transistor amplifier 40.

Figure 5:
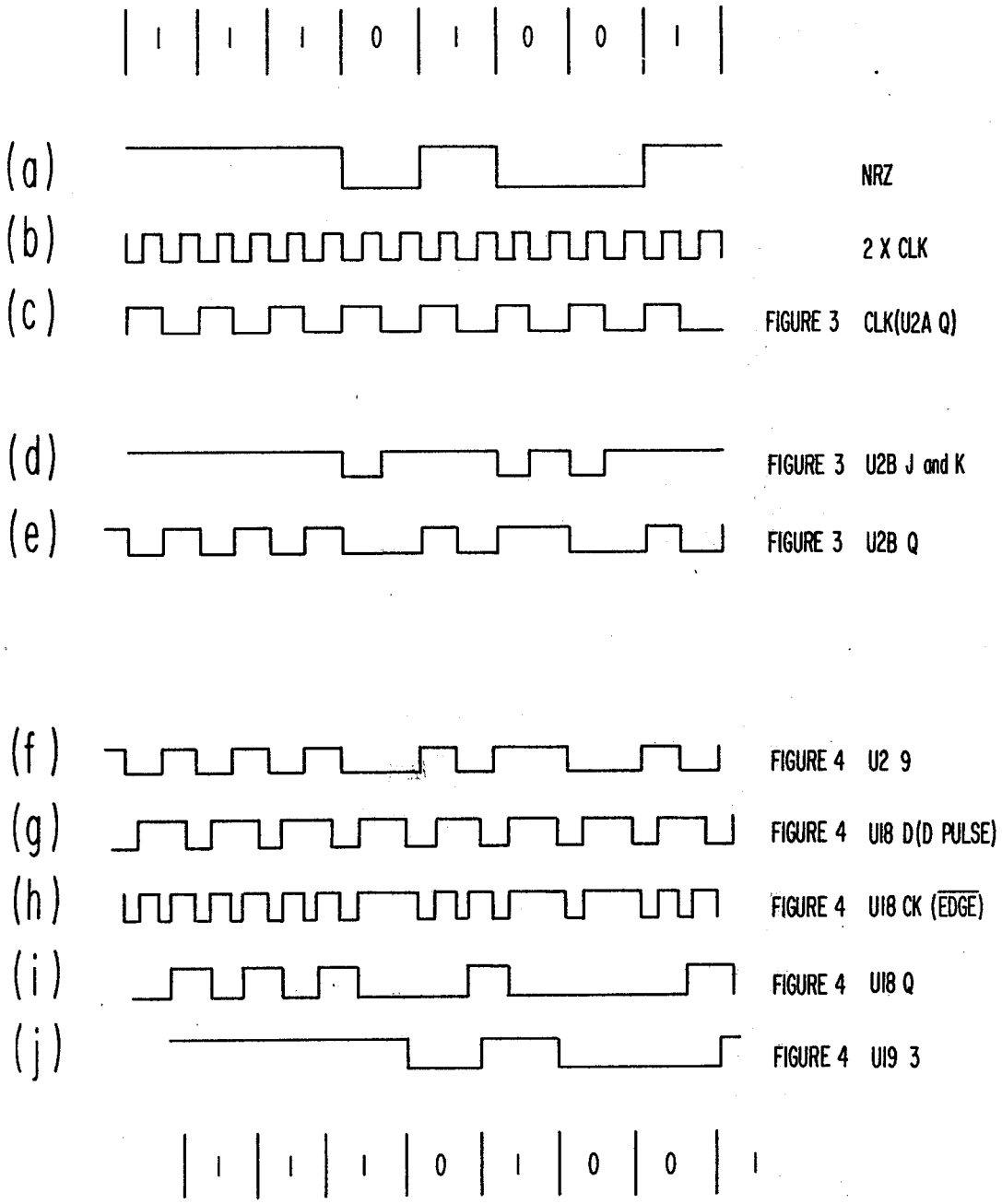
FIGS. 5(*a–j*) are illustrative waveform diagrams with the various points in FIGS. 3A, 3B, 4A, and 4B indicated to the right of each waveform, for convenience, the data bits in each bit period or cell are shown at the top and bottom of FIG. 5.

The output of transistor amplifier 40 is the bi-phase space encoded data. The edges trigger the non-retriggerable monostable multivibrator U-3 and the length of time the Q output of this multivibrator is high is determined by capacitor 45 and resistors 46 and 47, resistor 46 being adjusted so that the D pulse output is three quarters the bit time of the information. With the bi-phase space/mark code described above, when the first zero of the data occurs, the monostable begins to trigger on the edge that exists at the end of the bit cell. As noted earlier, there is a transition at the beginning of every bit period which is the same as the end of the bit cell for the succeeding period. The edge that occurs, due to a one on the middle of the bit cell is ignored due to the timing and delay which comes about from the adjustments of the capacitors and resistors described above. The edge is then utilized to clock the CLK or clock input to D flip flop U-18, and the D pulse is applied to the D input of edge detector U-18, with the Q output thereof shown in FIG. 5. The negative edge of the D pulse is used to store the output of U-18 into the input register of the eight bit input register U-19. The NRZ data is recovered as shown in FIG. 5. The NRZ data at the Q output of U-18 may be supplied to a shift register (not shown) for transposition purposes, if desired.

Referring now to the retriggerable monostable multivibrator U-4, as long as the positive going edges occur in less than the predetermined time, the monostable is reset and begins timing out again. If, due to a slow tape speed, data dropout or recorder stopping, or no information being recorded on the tape, e.g., a blank tape, no edge occurs in the D pulse input of retriggerable data detector U-4 and the device times out and clears the sync counter constituted by integrated circuits U-10A and U-10B and the input register both of which prevent notes from being struck or held in a closed state. The timing shown in FIG. 6 is adjusted to just longer than the expected time between the positive going edge of the D pulse. If the edge does not occur during the expected time, the output drops and clears the system.

THE SYNC COUNTER

As discussed earlier (FIGS. 4A and 4B), if there is a loss of synchronization, wrong notes can be struck by the musical instrument which can be quite disconcerting. The prior systems sensed these sync codes and automatically reset. In accordance with the present invention to insure that at power on, and at the start of a tape recorder or after a data dropout on the tape, no wrong notes are struck, a sync counter has been utilized to count three sync codes before allowing any note to be struck (these would be the three sync sequences in the bit assignment chart at bit positiions 121–128). This counter is reset by the output of data detector circuit U-4 line 48 (labeled "$\overline{\text{Blank}}$") that detects if there is data dropout on the tape or the tape recorder is running at the wrong speed or that the power has just been turned on. This sync counter, constituted basically by integrated JK flip flop circuits U-10A and U-10B, also allows for the possibility that the sync code could possibly occur randomly in the data information and rejects the false sync.

The retriggerable data detector circuit U-4 has a $\overline{\text{blank}}$ output which clears the counter to a zero count if there is not any data being received, at power on, if the tape dropout occurs or if tape speed variations exist. If the Q output of U-10A or U-10B is zero, U-11B NAND gate is high, a register clear pulse clears all output registers to thereby prevent any keys (notes) from being played. Therefore, until both JK flip flops U-10A and U-10B outputs are high (one) there cannot be any notes played or struck. NAND gate U-13A output "load" holds the bit counters U-14 and U-15 to all ones count, which, in turn, is detected by NAND gate U-9. When the incoming data from U-18 is shifted through the eight bit input register U-19, and contains no sync code, the NAND gate U-6 detects same and sync detect output becomes low. When the outputs of NAND gates U-6 and U-9 are low as well as the Q output of JK flip flop U-10B and the data detector (Q of U-4) is high, the next pulse (the D pulse at Q of U-3) is coupled through resistor R-11 and diode CR-2 and delayed by capacitor 38 and clocks U-10A and U-10B as well as clocking the bit counter which has been released by U-13A load 27 output.

At this time, the J and K outputs of flip flop U-10A are zero and the J and K outputs of U-10B are one and the CLK changes U-10B Q to a one and inverted Q to a zero. The bit counter U-14, U-15 continues to count until it counts 128 counts and returns to all ones again. If the data is correct and the retriggerable data detector U-4 $\overline{\text{blank}}$ output stays high, the sync code is again in the eight bit register U-19. U-6 and U-9 detect the sync time again together which allows U-10A J to go to a one and the U-10A K to zero, while U-10B J and K go to one. When the U-10A and U-10B are clock, they both change states so as U-10A Q is one and U-10B is zero. The register clear (Reg. Clr) signal stays high and the keys are still not allowed to play. After 128 more counts, U-10B J is high and upon clocking, U-10B Q becomes a one and the register clear becomes a zero, thus allowing the notes to be struck. In essence, then, the system requires two complete frames of 128 bits before any notes may be struck after any disturbance causing the data detector or sync detect NAND gate to indicate a malfunction. As indicated earlier, the counting of two frames of sync pulses is illustrated in the context of Vincent U.S. Pat. No. 3,905,267.

DEMULTIPLEX AND LATCH

The bit counters U-14 and U-15 along with the 8 bit input register U-19 demultiplex the serial data stream from the Q output terminals of U-18. Each succeeding bit is sequentially shifted into shift register U-19, and then transferred to latch circuits L-1, L-2. . .L-N corresponding to the number of modules (10 in this case) containing key switches S-1 – S-80. Bit counter outputs CTR-8, CTR-16, CTR-32 and CTR-64 are supplied to 4 line to 16 line converter U-5 so that upon the output lines thereof appear, in sequence, enabling pulses for each of the latch circuits L. Bit counter outputs CTR-1, CTR-2, CTR-4 are the unit select inputs to expression and pedal latch circuits EPL-1 and EPL-2 (U-20 and U-21).

As shown in FIG. 4B each latch circuit L1, L2. . .LN receives the data bits on their respective data input terminals D (terminal 13) from the 8-bit input register U19 (Fig. 4A) which delays the data one bit time. The data is supplied serially in the storage units of the latch circuits L1, L2. . .LN. As the data is sent, counters U14–U15 (FIG. 4B) and the 4-line to 16-line converter U5 set the storage place in the latch circuits for each bit. Thus, the counter 1, counter 2, and counter 4 output bits (CTR1, CTR2, and CTR4) determine which place a bit is to be stored in a group of eight so that as each latch circuit is enabled, the data bits issuing from the 8-bit input reigster, delayed one bit at a time, are stored in the latch circuits with the outputs of the 4-line to 16-line converter (U5 of FIG. 4B). A total of 16 groups times 8 per group which makes 128 channels with the first group being selected by the one output terminal of U5 and as indicated in FIG. 4B (see paragraph 3.5.6 "Data Transfer" of the Teledyne Service Manual).

Thus, each of the latch circuits L stores the musical information contained in a data cell of the 128 bit time frame. Driver transistor AND gates DG, one for each key on the keyboard receive as one input a signal from the latch or storage circuits L. The second input to the driver transistor AND gate DG is a sequence of pulses which are pulse width modulated according to the information stored in expression and pedal control latch circuits EPL.

EXPRESSION

A low frequency (200 Hz) oscillator 70 supplies pulses to a pair of pulse width modulatable one shot monostable multivibrators 71 and 72 for the bass and treble keys, respectively. The pulses from oscillator 70 have their minimum width set by a variable resistor 73 which thus sets the minimum width of the pulses from multivibrators 71 and 72. Each multivibrator 71 and 72 has its timing set by capacitors 74 and 75, respectively, in conjunction with resistors 76–80 for the bass theme and resistors 81–85 for the treble theme. Combinations of resistors 76–80 and combinations of resistors 81–85 are selected by the information contained in counter bits CTR-1 – CTR-4 which have been stored in expression and pedal control latch circuits U-20 and U-21, which are enabled by two successive outputs ($\overline{\text{line 13}}$ and $\overline{\text{line 14}}$) from the four line to sixteen line converter U-5. This stores the treble and bass expression bits in latch circuits EPL-1 and EPL-2 along with the soft and sustain pedal conrols. It will be noted that the latter are also prevented from being actuated on data dropout, loss of sync, etc. by a "Register Clear" signal at U-17B and U-17D. The stored bits are used to vary the number of resistors R76–R80 and R81–R85 (which are essentially binary weighted) in circuit with timing capacitors 74 and 75, respectively, to thereby vary the charging rate of the capacitors according to the combination of resistors which have been, in effect, connected in circuit with a capacitor (74 or 75), to thereby vary the width of the pulses established by U-22A for bass effects and U-22B for treble effects.

The bass effect pulse width pulses are supplied to the group of driver transistor AND gates DG-B for the bass notes solenoid control as the second input thereto and the treble effect pulse width modulated pulses are supplied to the driver transistor AND gates DG-T for the treble note solenoid control transistors.

If the sync pulse sequence is detected and there has been no loss of sync, data dropout, etc. as described above, the musical notes stored in the latch circuits are played.

It will now be seen how the invention accomplishes its various objects and the various advantages of the invention will likewise be apparent. While the invention has been described and illustrated herein by reference to certain preferred embodiments, it is to be understood that various changes and modifications may be made in the invention by those skilled in the art, without departing from the inventive concept, the scope of which is to be determined by the appended claims.

What is claimed is:

1. In a method of recovering musical signals from a serial musical data bit stream for the re-creation of a musical presentation comprising the steps of:
   - recovering the said musical signals from said serial musical data bit stream,
   - detecting the loss of at least one musical data bit in said recovered data bit stream, and
   - preventing the playing of any further notes immediately upon detection of loss of said at least one bit.

2. The invention defined in claim 1, wherein said data stream is in relative time frames, each time frame containing its own sequence of musical information bits and frame sync bits in data cells,
   - the further step of detecting at least more than one set of said frame sync bits, and
   - causing the resumptiion of re-creating said musical presentation upon detection of said at least more than one set of frame sync bits.

3. The method defined in claim 1 including the step of detecting decrease in the rate of said serial data stream, and preventing the playing of any further notes upon detection of said decrease in rate.

4. In a method of preventing the playing of erroneous notes due to the transmission of digital data containing data bits in data cells, each data cell having a beginning and an ending, said data bits corresponding to the actuation or non-actuation of the controls of a musical instrument, comprising the steps of assigning each musical note to a data cell, locating a timing signal transition at the beginning of each data cell, and between said beginning and ending of said data cell locating a signal transition or non-transition in each said data cell according to the actuation or non-actuation, respectively, of said controls.

5. In a method of preventing the playing of erroneous notes due to the transmission of digital data contained in data cells as defined in claim 4, the improvement wherein said data to be transmitted is recorded on magnetic tape and said signal transitions or non-transitions are magnetic flux transitions and non-transitions.

6. Improvements in a magnetic tape playback apparatus for the re-creation of a musical presentation encoded in time frames of a serial data bit stream on a magnetic tape, means for reading said magnetic tape and causing the playing of the musical notes of said musical presentation in said time frames of said serial data bit stream to re-create a recorded musical presentation, first means connected to said means for reading for detecting the loss of at least one data bit in said serial data bit stream and second means operative on said first means detecting loss of a data bit for preventing the playing of any further notes in the re-creation of said musical presentation.

7. The invention defined in claim 6 including means for resuming the re-creation of said musical presentation upon detection of at least two successive of said time frames.

8. The invention in claim 6 wherein a change in the rate of said serial data stream constitutes said loss of at least one data bit, and said means for detecting detects said change in rate.

9. In an apparatus for the re-creation of a musical presentation in the form of serial binary data bits recorded in discrete time frames on a storage medium, the improvement comprising, means for scanning in the serial order stored, the binary data bits, detector means connected to said means for scanning for detecting the loss of one data bit, and means controlled by said detector means for preventing the playing of any further portions of said musical presentation upon said detector means detecting the loss of one data bit.

10. In an electronic keyboard musical instrument having selectively actuatable key switch devices, means for scanning said key switch devices and producing sequential frames of time division multiplexed electrical signals from the musical information represented by the selectively actuated condition of said keys, and a magnetic tape storage medium, biphase encoding means for encoding said time division multiplexted signals, and means for recording said biphase encoded time division multiplexed signals on said magnetic tape storage medium as magnetic flux transitions, improvement in said biphase encoding means which comprises means for generating a repeating series of musical data cells, each data cell being delineated from an adjoining musical data cell by a sharp timing signal transition and each data cell carrying a predetermined note according to the actuation or non-actuation of one of said selectively actuatable key switch devices, each time frame containing a serial sequence of musical data cells, there being a timing signal transitions at the beginning of each musical data cell and the presence or absence of one additional signal transition proximate the center of each musical data cell, respectively, constitutes the musical information corresponding to the actuation or non-actuation of said key switches, respectively, so that the predominant number of musical data cells are in a zero format wherein the data stream has the effect of essentially all zeros and no musical notes stored therein if a data dropout occurs, and recording signal transitions on said magnetic tape in the form of magnetic flux transitions whereby the timing signal transitions and musical actuated key switch information are constituted solely by magnetic flux transitions on said tape, respectively.

11. A playback system for the magnetic tape storage medium defined in claim 10 comprising:

reading means for detecting said magnetic flux transitions recorded on said magnetic tape to produce a serial stream of encoded musical data bits, decoding means for decoding the encoded musical data bits, demultiplexing means for demultiplexing and storing the decoded musical data bits, electrically operated music producing keyboard means having selectively actuatable keys, and means for applying the stored data as decoded to the keys of said electrically operated music producing keyboard means to reproduce the music as recorded.

12. The invention defined in claim 11 including means for preventing the playing of any notes on loss of any data in any one time frame.

13. The invention defined in claim 10 wherein said means for generating a repeating series of time frames includes means for generating a sequence of synchronizing bits at a selected position therein to constitute a synchronizing signal, counter means connected to said reading means for counting at least two sets of synchronizing bits, and means controlled by said counter means for preventing the playing of any notes by said music producing means until a continuous sequence of two sets of synchronizing bits occurs in at least two succeeding time frames.

* * * * *